US007065989B2

(12) United States Patent
Lonati et al.

(10) Patent No.: US 7,065,989 B2
(45) Date of Patent: Jun. 27, 2006

(54) SINKER SELECTION DEVICE IN A CIRCULAR KNITTING MACHINE

(75) Inventors: Ettore Lonati, Brescia (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 226 days.

(21) Appl. No.: 10/935,758

(22) Filed: Sep. 8, 2004

(65) Prior Publication Data

US 2005/0081569 A1 Apr. 21, 2005

(30) Foreign Application Priority Data

Oct. 15, 2003 (IT) ..... MI2003A1995

(51) Int. Cl.
*D04B 35/00* (2006.01)

(52) U.S. Cl. ..... 66/93; 66/107

(58) Field of Classification Search ..... 66/91, 66/92, 93, 104, 106, 107, 108 R, 108 A
See application file for complete search history.

(56) References Cited

U.S. PATENT DOCUMENTS 2,116,358 A 5/1938 Henry et al.
4,314,461 A * 2/1982 Conti ..... 66/13
5,184,483 A * 2/1993 Conti ..... 66/93
5,931,025 A * 8/1999 Lonati et al. ..... 66/217
6,105,402 A 8/2000 Lee
6,286,343 B1 * 9/2001 Sangiacomo ..... 66/217

FOREIGN PATENT DOCUMENTS

| | | |
|---|---|---|
| EP | 0 454 023 | 10/1991 |
| EP | 0 629 727 | 12/1994 |
| EP | 1 338 691 | 8/2003 |
| GB | 350 830 | 6/1931 |

* cited by examiner

*Primary Examiner*—Danny Worrell
(74) *Attorney, Agent, or Firm*—Guido Modiano; Albert Josif; Daniel O'Byrne

(57) ABSTRACT

A sinker selection device in a circular knitting machine, comprising for each radial slot of the sinker ring in which sinkers are accommodated, a selector facing the end of the corresponding radial slot directed away from the axis of the sinker ring, the selector being oscillatable on a radial plane with respect to the sinker ring to pass from active to inactive positions, and connected to the corresponding sinker, arranged in the corresponding radial slot, to induce different actuation of the corresponding sinker along the corresponding radial slot, depending on whether the selector is in the inactive position or in the active position. A selection actuator is provided which laterally faces the sinker ring and can engage on command the selector for transfer from inactive to active positions.

14 Claims, 4 Drawing Sheets

SINKER SELECTION DEVICE IN A CIRCULAR KNITTING MACHINE

The present invention relates to a sinker selection device in a circular machine for knitting, hosiery or the like.

BACKGROUND OF THE INVENTION

In the execution of particular work with single-cylinder knitting machines or hosiery knitting machines, such as for example for forming relief patterns obtained by means of toweling-stitch work, there is a requirement to be able to select the sinkers individually, so as to actuate contiguous sinkers in different manners in order to form stitches of the toweling type only with some needles, differently from contiguous needles, which instead form non-toweling stitches.

Selection devices that require the use of particular sinkers, different from conventional sinkers, are currently used to meet this requirement.

More particularly, one of these selection devices uses sinkers provided with a substantially L-shaped body, in which one arm of the L-shape constitutes the shank of the sinker and the other arm of the L-shape is arranged on the outer side of the sinker ring and is provided with a selection tooth. Said selection tooth can be engaged or not by a selection actuator, which laterally faces the sinker ring so as to produce a diversified actuation of the sinker along the corresponding radial slot of the sinker ring in which it is accommodated, depending on whether one wishes said sinker to cooperate with the needles in forming a toweling stitch or to cooperate with the needles in order to form another stitch.

Another type of sinker selection device requires the use of sinkers that can oscillate on a radial plane with respect to the sinker ring. Said sinkers are generally provided, on their side that is directed toward the bottom of the corresponding radial slot of the sinker ring, with a selection tooth, which protrudes downwardly from the sinker ring and which, depending on the selection requirements, is contacted or not by a selection actuator that faces the sinker ring in a downward region. If the selection tooth is contacted by the selection actuator, the corresponding sinker undergoes an upward oscillation, which makes it engage sinker actuation cams supported by the sinker cap, which faces the sinker ring in an upward region; said sinkers cause the diversified actuation of the sinker with respect to the actuation performed by means of other cams that engage the sinker when it is not raised, i.e., when the selection actuator does not act on the selection tooth. In in this manner also, the diversified actuation of the sinker allows to actuate the sinker so that it must cooperate with the needles of the to machine in forming toweling stitches or in the forming of other stitches.

These sinker selection devices have the drawback of requiring special sinkers, which have a higher cost than conventional types of sinker. As sinkers are elements of the machine that need to be replaced periodically, having to use special sinkers affects the operating costs of the machine.

Moreover, in the case of devices that require the use of special oscillating sinkers, there are problems in controlling the sinkers when the machine operates at high actuation speeds. In this type of device there are also problems in positioning the selection actuator below the sinker ring, in a region of the machine that is generally already occupied by many other elements required for its operation.

SUMMARY OF THE INVENTION

The aim of the present invention is to solve the problems noted above by providing a sinker selection device in a circular machine for knitting, hosiery or the like that allows to perform individual selection of the sinkers despite using sinkers that are substantially of a conventional type.

Within this aim, an object of the invention is to provide a device that can use a selection actuator that can be easily positioned on board the machine.

Another object of the invention is to provide a device that allows to perform sinker selection in both directions of rotation of the needle cylinder about its own axis.

Another object of the invention is to provide a device that is highly reliable in performing sinker selection even at high operating speeds of the machine.

This aim and these and other objects that will become better apparent hereinafter are achieved by a sinker selection device in a circular knitting machine for hosiery or the like, of the type that comprises a sinker ring that is coaxially associated with the needle cylinder at its upper end and a sinker cap that faces said sinker ring in an upward region, said sinker ring being actuatable with a rotary motion about its own axis with respect to said sinker cap, a plurality of radial slots being formed in said sinker ring, said slots each slidingly accommodating a sinker that has at least one heel that protrudes upwardly from the corresponding radial slot and can engage sinker actuation cams that face in an upward region said sinker ring and are associated with said sinker cap, characterized in that it comprises, for each one of said radial slots, a selector that faces the end of the corresponding radial slot that is directed away from the axis of the sinker ring, said selector being able to oscillate on a radial plane with respect to the sinker ring in order to pass from an active position to an inactive position or vice versa, and being connected to the corresponding sinker arranged in the corresponding radial slot in order to induce a different actuation of the corresponding sinker along the corresponding radial slot, depending on whether said selector is in the inactive position or in the active position, a selection actuator being provided which laterally faces the sinker ring and can engage on command said selector in order to transfer it from the inactive position to the active position.

BRIEF DESCRIPTION OF THE DRAWINGS

Further characteristics and advantages of the invention will become better apparent from the description of a preferred but not exclusive embodiment of the device according to the invention, illustrated by way of nonlimiting example in the accompanying drawings, wherein.

DESCRIPTION OF THE PREFERRED EMBODIMENTS

Figure 1:
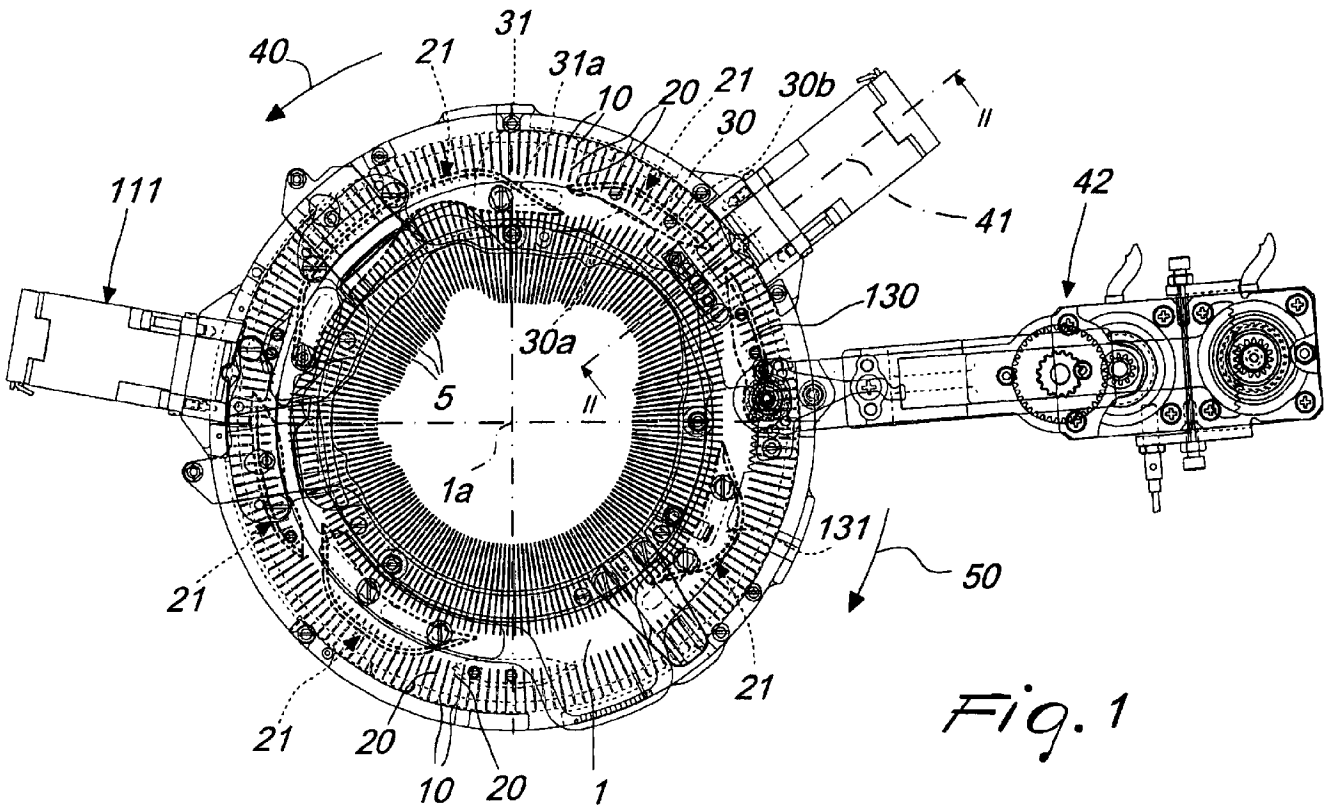
FIG. 1 is a schematic view of the sinker ring of a circular hosiery knitting machine on which the device according to the invention is fitted, illustrating the actuation of the sinkers in the forming of plain stitches.

With reference to the figures, the device according to the invention is meant to be fitted on a circular knitting machine or hosiery knitting machine, of the single-cylinder type, which comprises a sinker ring 1, which is fixed coaxially to the needle cylinder 2 at its upper end, and a sinker cap 3, which faces in an upward region the sinker ring 1. The sinker ring 1 can be actuated so as to rotate about its own axis 1*a*, which coincides with the axis of the needle cylinder 2, rigidly with the needle cylinder 2, with respect to the sinker cap 3.

A plurality of radial slots 4 are formed in the sinker ring 1; each slot slidingly accommodates a sinker 5, which is provided with at least one heel 5*a*, which protrudes upwardly from the corresponding radial slot 4 and can engage sinker actuation cams 6, which face the sinker ring 1 in an upward region. The sinker actuation cams 6 are associated with the sinker cap 3 and define paths for the heels 5*a* of the sinkers 5. These paths are shaped so that as a consequence of the rotation of the sinker ring 1 about the axis 1*a* with respect to the sinker cap 3 and therefore with respect to the sinker actuation cams 6, the sinkers 5 are moved toward or away from the axis 1*a* along the corresponding radial slot 4 to cooperate with the needles 7 of the machine in forming the knitting, in a per se known manner. It should be noted that the sinker actuation cams 6, in addition to acting on the heel 5*a* of the sinkers 5, can act also on the back 5*b* of the sinkers 5, in order to control the movement of the sinkers 5 toward or away from the axis 1*a*, in a per se known manner.

The device according to the invention comprises, for each one of the radial slots 4, a selector 10, which faces the end of the corresponding radial slot 4 that is directed away from the axis 1*a* of the sinker ring 1. The selector 10 can oscillate on a radial plane with respect to the sinker ring 1 in order to pass from an inactive position to an active position or vice versa. The selector 10 is connected to the corresponding sinker 5, which is arranged in the corresponding radial slot 4, in order to produce a different actuation of the corresponding sinker 5 along the corresponding radial slot 4, depending on whether the selector 10 is in the inactive position or in the active position, as will become better apparent hereinafter. The device according to the invention further comprises a selection actuator 11, which laterally faces the sinker ring 1 and can engage on command the selector 10 in order to transfer it from the inactive position to the active position.

More particularly, the selector 10 has a flattened shape and is accommodated inside an extension of the corresponding radial slot 4 that runs along the lateral face of the sinker ring 1 that is directed away from the axis 1*a*. Said selector 10 has an elongated shape and is arranged substantially parallel to the axis 1*a* except for the inclination that is induced, with respect to said axis, in the transfer from the inactive position to the active position. The selector 10 can oscillate on its plane of arrangement, i.e., on a radial plane with respect to the sinker ring 1, about a selector axis 10*a* that is arranged proximate to the lower end of the selector.

For this purpose, the lower end of the selector 10 has a circular profile that is coupled rotationally within a seat 12, which is formed inside a supporting ring 13 arranged coaxially to the sinker ring 1. The supporting ring 13 is fixed to the sinker cap 3, and a bearing 14 is interposed between the supporting ring 13 and the sinker ring 1.

Conveniently, the selectors 10 are coupled in the seat 12 so that they can slide circumferentially about the axis 1*a* of the sinker ring 1, so that the selectors 10 follow the sinker ring 1 in its rotary motion about the axis 1*a*, sliding in the seat 12 of the supporting ring 13, which remains stationary, during this rotation, with the sinker cap 3.

The selector 10 has, on its side directed away from the axis 1*a* of the sinker ring 1, at least one selection heel 15, which can be selectively engaged, i.e. engaged or not by the selection actuator 11 in order to transfer the selector 10 from the inactive position to the active position or to keep the selector 10 in the inactive position. Contiguous selectors 10 with which the sinker ring 1 is fitted have selection or selector heels 15 arranged at mutually different heights in order to allow, if required, a different intervention of the selection actuator 11 on contiguous selectors 10. The selection actuator 11 is provided with selection levers 16 arranged at mutually different heights so as to match the heights of the selection heels 15. Said selection levers 16 can move on command in order to interfere or not with the corresponding selection heels 15, depending on whether one wishes to move the corresponding selectors 10 into the active position or keep the selectors 10 in the inactive position.

The selection levers 16 can be controlled and actuated, in order selectively interfere, i.e. to interfere or not with the corresponding selection heels 15, by way of mechanical, magnetic, pneumatic, electromagnetic means or other known actuation means, and can be provided so as to be able to perform a translational motion or an oscillation, such as the one shown, according to the requirements. The selection actuator 11 is functionally connected to an electronic actuation and control element, not shown for the sake of simplicity, which supervises the operation of the entire machine and actuates the selection levers 16 so that they interfere or not with the selection heels 15, according to preset work programs.

Preferably, each selector 10 is connected to the corresponding sinker 5 by way of a pusher 20, which is arranged in the corresponding radial slot 4 of the sinker ring 1 and is interposed between the selector 10 and the corresponding sinker 5.

Said pusher 20 has a heel 20*a*, which protrudes upwardly from the corresponding slot 4 of the sinker ring 1 and can engage pusher actuation cams 21 that face in an upward region the sinker ring 1 and are associated with the sinker cap 3.

The pusher actuation cams 21, described in greater detail hereinafter, form at least two diversified paths for the heel 20*a* of each pusher 20: a first path and a second path, which can be engaged selectively by the heel 20*a* of the pusher 20, depending on whether the selector 10 that acts on said pusher 20 is in the active position or in the inactive position.

The pusher 20 has a portion that protrudes toward the axis 1*a* of the sinker ring 1 and is arranged between the bottom of the corresponding radial slot 4 and the base of the corresponding sinker 5. More particularly, the pusher 20 is preferably substantially L-shaped, with an arm 20*b* of the L-shape that rests on the bottom of the corresponding radial slot 4 and with the other arm 20*c* of the L-shape that rises from the bottom of the corresponding radial slot 4 and faces the corresponding selector 10. This arm 20*c* of the pusher 20 ends, at its end that is directed upwardly, with the heel 20*a*, which preferably tapers upwardly.

The pusher actuation cams 21 comprise a first cam 30, which is arranged proximate to the selection actuator 11 and is provided with two active profiles: a first active profile 30*a*, which is directed toward the axis 1*a*, and a second active profile 30*b*, which is directed away from the axis 1*a*. The first active profile 30*a* defines the first path for the heel 20*a* of the pushers 20 and is engaged by the heels 20*a* of the pushers 20 whose corresponding selector 10 is in the active position, while the second active profile 30*b* defines the second path for the heels 20*a* of the pushers 20, which is engaged by the heels 20*a* of the pushers 20 whose selectors 10 are in the inactive position. In practice, if the pushers 20 pass with their heel 20*a* over the first active profile 30*a*, the corresponding pushers 20 act on the sinkers 5, causing, during a step of the forming of the knitting, a greater advancement of the sinkers 5 toward the axis 1*a*, which forms toweling stitches, while the pushers 20 that engage, with their heel 20*a*, the second active profile 30*b* have no effect on the sinkers 5, which are actuated exclusively by the cams 6 usually provided on the knitting machine or hosiery knitting machine in order to form plain stitches or other stitches different from toweling stitches.

The cams for actuating the pushers 20 comprise a reset cam 31, which is arranged downstream of the first cam 30 along the direction of rotation 40 of the sinker ring 1 with respect to the sinker cap 3 and has an active profile 31*a* that moves gradually away from the axis 1*a*. This active profile 31*a* of the cam 31 can be engaged exclusively by the heels 20*a* of the pushers 20 that followed the first active profile 30*a* of the cam 30, and is meant to move the corresponding pushers 20 away from the axis 1*a* until the corresponding selector 10 is moved from the active position to the inactive position in order to undergo again selection on the part of a selection actuator 11.

The embodiment shown relates to a circular hosiery knitting machine with two feeds, with a selection actuator 11 arranged at a feed of the machine that is used both in the rotation of the needle cylinder about its own axis in one direction 40 and in an opposite direction 50, and with another selection actuator 111 that is arranged at another feed or drop of the machine. Preferably, with reference to the feed or drop of the machine that is used to feed the needles 7 in both directions of rotation 40 and 50 of the needle cylinder 2 about its own axis, there are two sets of pusher actuation cams 21, which are each constituted by a first cam 30, 130 and by a reset cam 31, 131, which are arranged substantially symmetrically with respect to a radial plane 41 of the sinker ring 1 that passes through the drop or feed of the machine that is used to feed the needles 7 in both directions of rotation 40, 50 of the needle cylinder 2 about the axis 1*a*. The selection actuator 11 is arranged at said feed or drop of the machine, so that the selection, i.e., the intervention or not of the selection levers 16 on the selection heels 15 of the selectors 10, occurs substantially at said radial plane 41.

For the sake of completeness in description, it should be noted that the machine can be equipped with a known type of device 42 that can adjust the position of the sinker cap 3 and therefore of the actuation cams associated therewith about the axis 1*a*, so as to anticipate or delay, according to the requirements, the intervention of said actuation cams on the elements, i.e., the sinkers 4 and the pushers 20, that are actuated by said cams, depending on the work requirements.

Furthermore, downstream of the selection actuator 111 arranged at another feed of the machine, pusher actuation cams 230 and 231, similar to the cams 30 and 31 described above, are associated with the sinker cap 3.

The operation of the device according to the invention is as follows.

For the sake of simplicity, the operation of the device is described with reference to the feed or drop of the machine that is served by the selection actuator 11, while the needle cylinder 2 and the sinker ring 1 rotate in the direction 40; it is understood that similar operation occurs at the feed or drop that is served by the selection actuator 111.

When one wishes a given sinker 5 to cooperate with the needles 7 in forming plain stitches or in any case stitches different from toweling stitches, the selection actuator 111 does not act with its selection levers 16 on the selection heel 15 of the corresponding selector 10. In this manner, the selector 10 remains in the inactive position and the corresponding sinker 5 is actuated in a per se known manner, exclusively by means of the sinker actuation cams 6. In this condition, in fact, the pusher 20 passes with its heel 20*a* over the second active profile 30*b* of the first cam 30 and therefore has no effect on the movement of the corresponding sinker 5, as shown in FIGS. 1 and 2.

When one wishes a sinker 5 to be actuated so as to cooperate with the needles 7, forming toweling stitches, the selection actuator 11 acts, with a selection lever 16, on the selection heel 15 of the corresponding selector 10, so as to transfer the selector 10 from the inactive position to the active position. As a consequence of this transfer, the pusher 20 moves toward the axis 1*a* of the sinker ring 1 and passes with its heel 20*a* over the first active profile 30*a* of the first cam 30. The profile 30*a* produces the, further translational motion of the pusher 20 toward the axis 1*a*, which pushes the corresponding sinker 5 toward the axis 1*a* more than the displacement that the sinker 5 would undergo exclusively by means of the sinker actuation cams 6, as shown in FIGS. 3 and 4.

Figure 2:
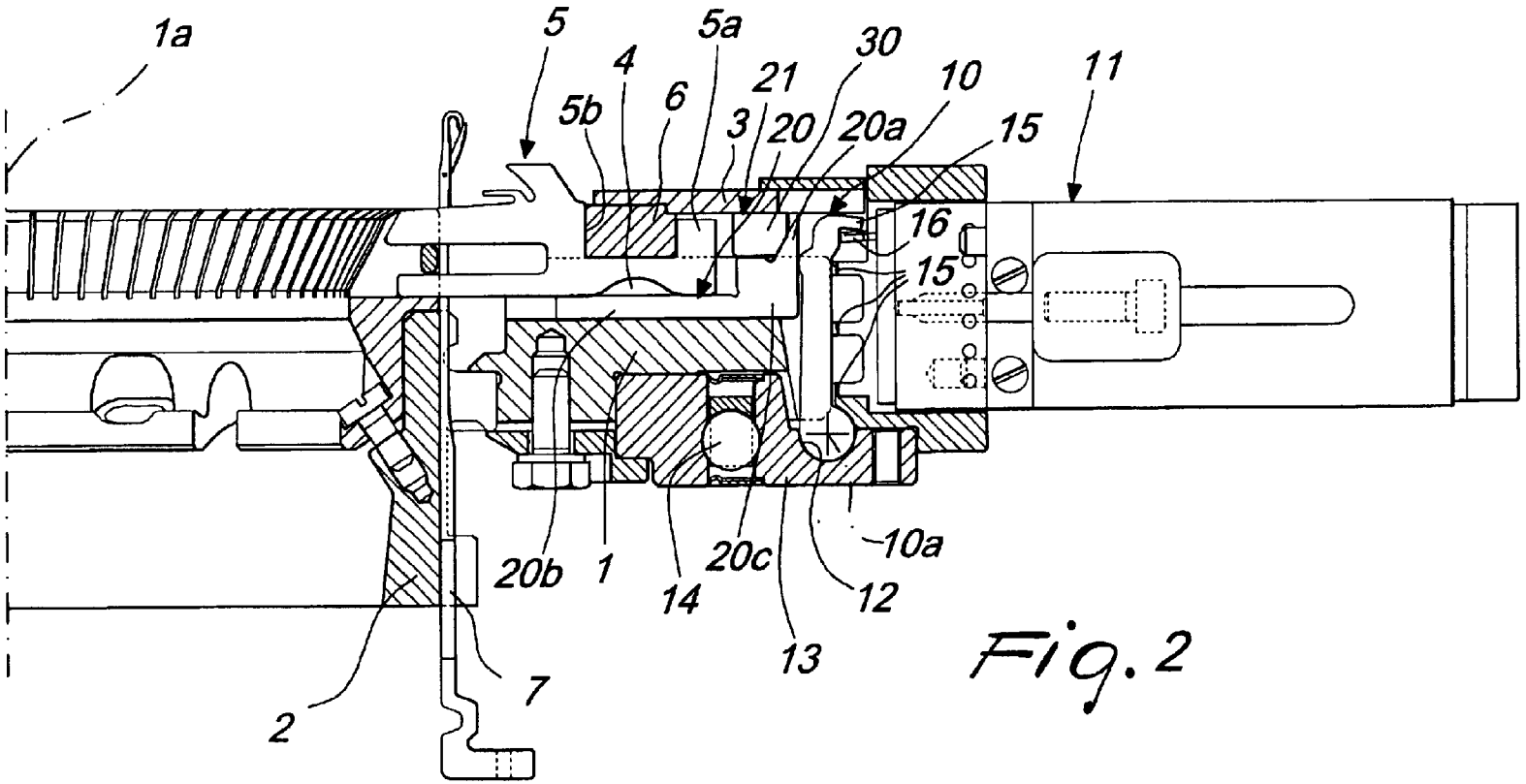
FIG. 2 is an enlarged-scale sectional view of FIG. 1, taken along the axis II—II.
Figure 3:
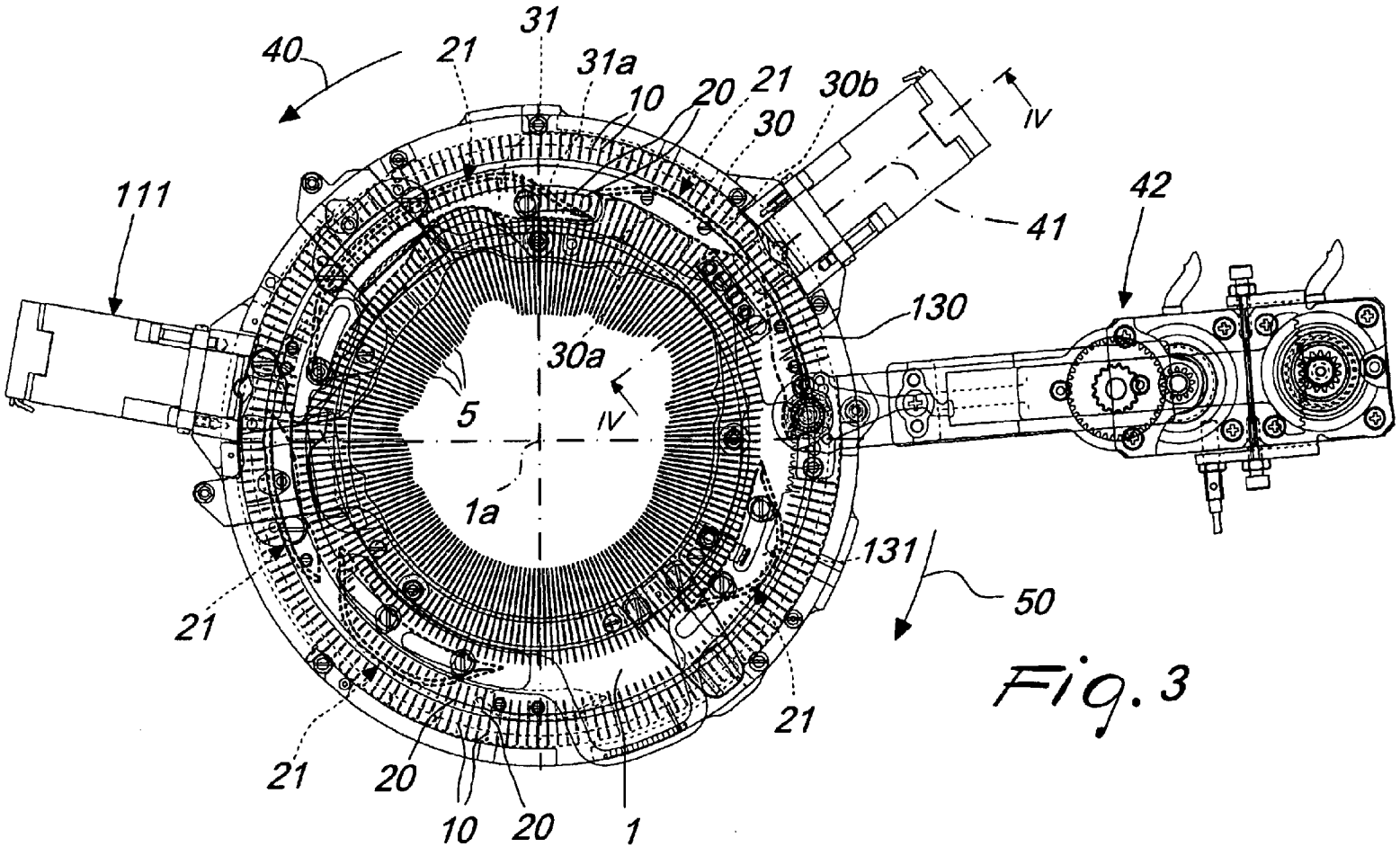
FIG. 3 is a view, similar to FIG. 1, of the sinker ring, highlighting the actuation of the sinkers in the forming of toweling stitches.
Figure 4:
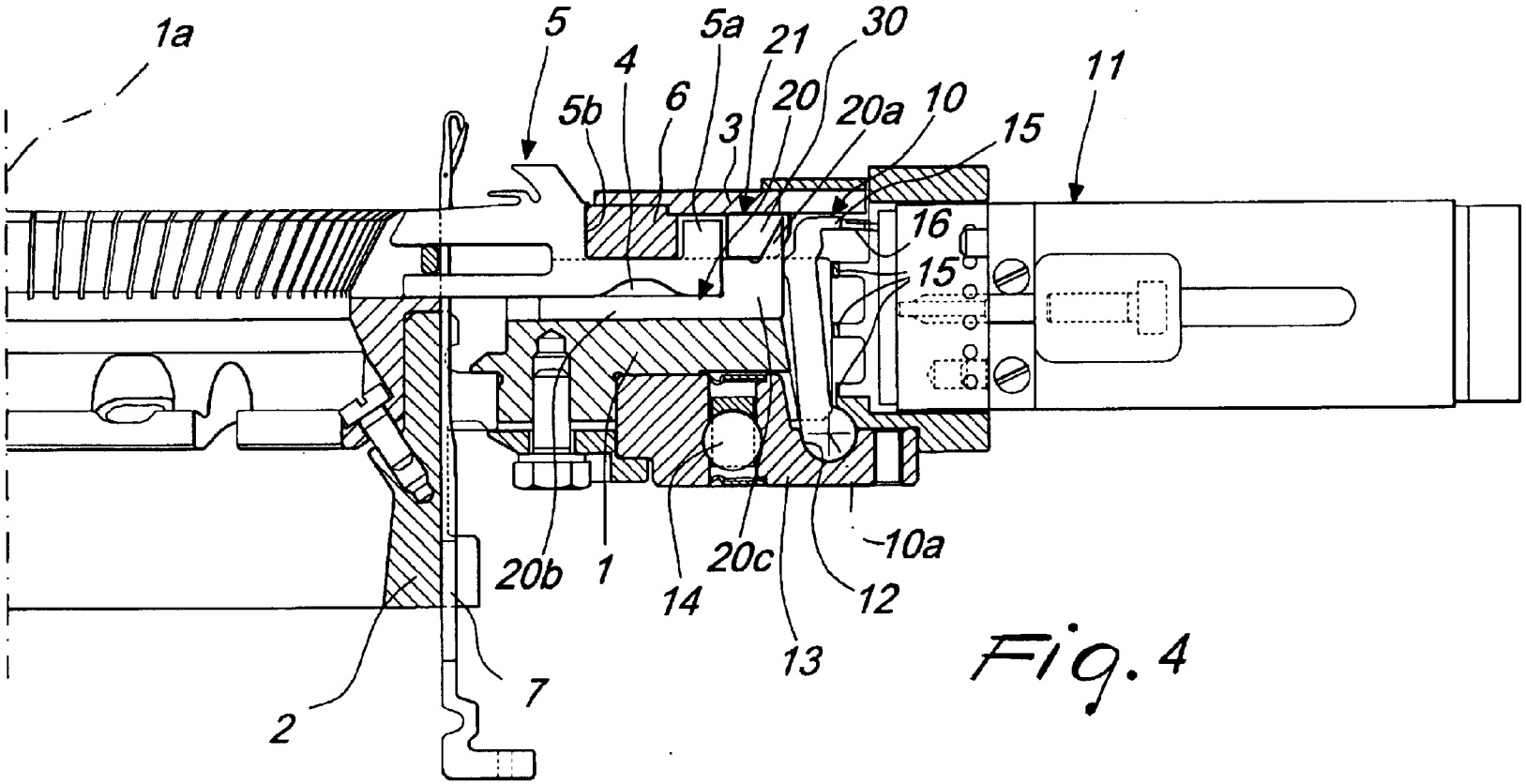
FIG. 4 is an enlarged-scale sectional view of FIG. 3, taken along the plane IV—IV.

The heel 20*a* of the pushers 20 that have passed over the first active profile 30*a* then engage the reset cam 31, which moves said pushers 20 away from the axis 1*a*, returning the pushers 20 to the initial condition and the corresponding selectors 10 to the inactive position, ready to be selected again by means of a subsequent selection actuator, for example the actuator 111 in FIGS. 1 and 3.

A kind of operation similar to the one just described occurs when the needle cylinder 2 and the sinker ring are actuated in the direction of rotation 50. In this case, the cams that act on the pushers 20 are constituted by the cams 130 and 131, which are similar to the cams 30 and 31.

In practice it has been found that the device according to the invention fully achieves the intended aim and objects, since it allows to perform individual selection of the sinkers despite using sinkers of a conventional type.

It should be noted that the selection device according to the invention has been described with reference to a selection of the sinkers actuated to form toweling stitches or stitches that are different from toweling stitches; however, the selection device according to the invention can also be used to obtain a diversified movement of the sinkers for other kinds of work, such as for example vanisé work.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2003A001995 from which this application claims priority are incorporated herein by reference.

What is claimed is:

1. A sinker selection device in a circular knitting machine that comprises: a needle cylinder; a sinker ring associated coaxially with the needle cylinder at an upper end thereof; a sinker cap that faces said sinker ring in an upward region thereof, said sinker ring being actuatable with a rotary motion about a sinker ring axis with respect to said sinker cap; sinkers; sinker actuation cams that face in an upward region thereof said sinker ring and are associated with said sinker cap; a plurality of radial slots formed in said sinker ring, said slots each accommodating slidingly corresponding one of said sinkers, each said sinkers having at least one heel that protrudes upwardly from the radial slot to engage the sinker actuation cams; selectors, being one for each one of said radial slots, each selector facing an end of the corresponding radial slot that is directed away from the sinker ring axis, and being oscillatable on a radial plane with respect to the sinker ring in order to pass from active to inactive positions, and being each connected to a corresponding sinker arranged in a corresponding radial slot in order to induce a different actuation of the corresponding sinker along the corresponding radial slot, depending on whether said selector is in the inactive position or in the active position; and a selection actuator which faces laterally the sinker ring and is adapted to engage on command said selectors in order to transfer the selectors from the inactive position to the active position.

2. The device of claim 1, wherein the selectors have an elongated shape and extend substantially parallel to the axis of the sinker ring, and are oscillatable on said radial plane with respect to the sinker ring about a selector axis that is arranged proximate to a lower end of said selector.

3. The device of claim 2, comprising pushers that are arranged each in a corresponding radial slot of the sinker ring, interposed between said selector and the corresponding sinker, each said selector being connected to the corresponding sinker by way of a corresponding one of said pushers.

4. The device of claim 3, comprising pusher actuation cams that face, in an upward region, the sinker ring and are associated with said sinker cap each said pusher having a heel that protrudes upward from the corresponding radial slot of the sinker ring for engaging said pusher actuation cams.

5. The device of claim 4, wherein said pusher actuation cams are shaped so as to define at least two diversified paths for said pusher heels, respectively a first path and a second path, said paths being engageable selectively by a heel of a corresponding pusher depending on whether the corresponding selector that acts on said corresponding pusher is in the active position or in the inactive position.

6. The device of claim 4, wherein said pushers have each a portion that protrudes toward the axis of the sinker ring and is arranged between a bottom of the corresponding radial slot and a base of the corresponding sinker.

7. The device of claim 6, wherein each said pusher has a substantially L-shape, with a first arm of the L-shape that rests on the bottom of the corresponding radial slot and with a second other arm of the L-shape that protrudes from the bottom of the corresponding radial slot and faces a corresponding selector.

8. The device of claim 4, wherein said heel of the pusher is of a shape that tapers upward.

9. The device of claim 3, wherein each said selector has, on its side directed away from the axis of the sinker ring, at least one selection heel that is selectively engageable by said selection actuator in order to transfer said selector from the inactive position to the active position or to keep said selector in the inactive position.

10. The device of claim 9, wherein contiguous selectors have selector heels that are arranged at mutually different heights, the corresponding selection actuator being provided with selection levers that are arranged at mutually different heights so as to match the heights of said selection heels, said selection levers being movable on command in order to selectively interfere with corresponding selection heels.

11. The device of claim 5, wherein said pusher actuation cams comprise at least one reset cam, which is arranged along said first path of said pusher heels so as to engage the pusher heels in order to move said pushers away from the axis of the sinker ring, with a consequent oscillation of the corresponding selector from the active position to the inactive position.

12. The device of claim 11, comprising at least two sets of pusher actuation cams, which are arranged substantially symmetrically with respect to a radial plane of the sinker ring that passes through a drop or feed of the machine.

13. The device of claim 11, wherein said selection actuator is arranged at a drop or feed of the machine that is usable in both directions of rotation of the sinker ring and of the needle cylinder about the sinker ring axis.

14. The device of claim 1, comprising a supporting ring that is associated with said sinker cap, a lower end of each said selector having a circular profile and being accommodated so as to be slideable circumferentially around the axis of the sinker ring in a seat that lies circumferentially in said supporting ring.

* * * * *